United States Patent [19]

Wiatrak

[11] 4,422,430

[45] Dec. 27, 1983

[54] METHOD AND A SYSTEM FOR THE CREATION OF TURBULENCE AND GASIFICATION OF THE AIR-FUEL MIXTURE

[75] Inventor: Wiesław Wiatrak, Bielsko-Biała, Poland

[73] Assignee: Osrodek Badawczo-Rozwojowy Samochodow Malolitrazowych Bosmal, Poland

[21] Appl. No.: 307,623

[22] Filed: Oct. 1, 1981

[30] Foreign Application Priority Data

Nov. 28, 1980 [PL] Poland ..... 228178

[51] Int. Cl.[3] ..... F02M 25/06

[52] U.S. Cl. ..... 123/568; 123/59 EC; 123/569

[58] Field of Search ..... 123/568, 59 EC, 569

[56] References Cited

U.S. PATENT DOCUMENTS

| | | | |
|---|---|---|---|
| 3,470,856 | 10/1969 | Gaines | 123/568 |
| 3,785,355 | 1/1974 | Toepel | 123/568 |
| 4,119,071 | 10/1978 | Hattori | 123/568 |
| 4,194,472 | 3/1980 | Amano et al. | 123/568 |

FOREIGN PATENT DOCUMENTS

| | | | |
|---|---|---|---|
| 344072 | 11/1921 | Fed. Rep. of Germany | 123/59 EC |
| 401675 | 11/1933 | United Kingdom | 123/59 EE |

*Primary Examiner*—Wendell E. Burns
*Attorney, Agent, or Firm*—Ladas & Parry

[57] ABSTRACT

The invention solves the problem of improving the preparation of an air-fuel mixture for the combustion processes thereof by its additional whirling and gasification.

The method according to the invention consists in the creation of turbulence and gasification of the mixture by exhaust gases collected directly from the combustion chamber of the engine cylinder in which a working stroke is being performed, whereby the flow to the co-operating cylinder in which a suction stroke is being performed is controlled by the duration of opening the suction valve.

The system for the creation of turbulence and gasification of the air-fuel mixture according to the invention has conduits (10, 14) connecting alternately a combustion chamber (9, 13) of a cylinder (1, 2) with exhaust ducts (22) in faces of seats (12, 16) of suction valves (3, 5), whereby the inlets of the conduits (10, 14) are provided with an insert (17) with a throttle nozzle (18) or with an insert (19) with more than one throttle nozzle (20).

The invention can be applied in spark-ignition four-stroke internal combustion engines with an even number of cylinders.

4 Claims, 4 Drawing Figures

Figure 1:
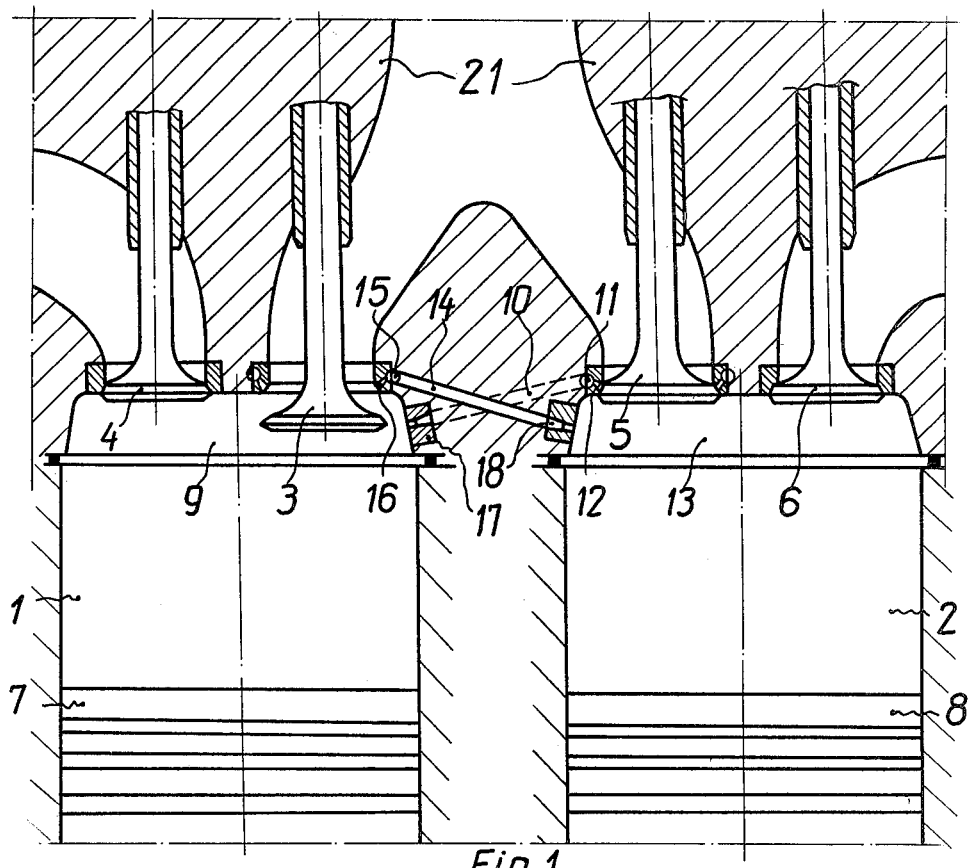

METHOD AND A SYSTEM FOR THE CREATION OF TURBULENCE AND GASIFICATION OF THE AIR-FUEL MIXTURE

The subject of the present invention is a method and a system for the creation of turbulence and gasification of the air-fuel mixture in a spark-ignition four-stroke internal combustion engine with an even number of cylinders.

From the German application No. 26 51 504 a method is known which consists in that to an air-fuel mixture obtained by any method exhaust gases coming from the same engine are introduced at high speed outside the device producing the mixture. The input of exhaust gases is effected from the exhaust manifold or from the working space of cylinders.

From the aforementioned application there is also known a system and a device for effecting this method. They comprise conduits for exhaust gases, which start with inlets situated in cylinder bearing surfaces in the region of their working spaces, or possibly situated in exhaust manifolds. Said conduits connect alternately working spaces or exhaust manifolds of one cylinders of an engine with seats of suction valves or with inserts in intake manifolds on other cylinders. Conduits for exhaust gases can be provided with small reservoirs for exhaust gases and/or with non-return valves.

Seats of suction valves or inserts mounted in intake manifolds are provided with circumferentail passages surrounding them, which are made in the material of the seats or of the inserts and/or in the material of the head. From the circumferential passages several exhaust passages for exhaust gases are led out, their outlets being directed to the interior of intake manifolds in the vicinity of heads of suction valves, or being situated in faces of the seats of suction valves. Exhaust passages can widen in the direction of their outlets, and they can be led askew or warpedly in relation to longitudinal axes of the suction valves.

A drawback of the aforesaid solution is that in case of exhaust gases being intaken through an opening in the cylinder bearing surface, it is impossible to avoid an unfavourable phenomenon of taking oil from the cylinder bearing surface, whereas in case of taking exhaust gases from exhaust passages, they have too small energy for their effect to be fully utilized.

The object of the invention is to design a method and a system for the creation of turbulence and gasification of the air-fuel mixture, eliminating the aforementioned drawbacks at a maintenance of all positive effects in a form of improving the preparation of the air-fuel mixture due to introducing micro- and macroturbulence therein and due to gasification of insufficiently atomized fuel.

The essence of the method of the creation of turbulence and gasification of the air-fuel mixture in a spark-ignition four-stroke internal combustion engine with an even number of cylinders consists in that to the air-fuel mixture obtained by any method exhaust gases collected directly from combustion chambers of the same engine are supplied outside the device preparing the mixture. Exhaust gases from the cylinders in which the working stroke is performed to the cylinders in which the suction stroke is performed are collected during the whole period of opening the suction valves in said cylinders.

The essence of the system for the creation of turbulence and gasification of the air-fuel mixture in a spark-ignition four-stroke internal combustion engine with an even number of cylinders, being the subject of the invention, wherein cylinders of the engine of a synchronous motion of pistons co-operate with one another in pairs, whereby when in one of the cylinders of a pair a working stroke is performed, then in the other one a suction stroke is performed and vice versa, consists in that the co-operating cylinders are connected with one another in the each-with-each manner by means of one or more conduits, whereby inlets of the conduits are situated in combustion chambers of said cylinders and the outlets are connected with known annular passages surrounding seats of suction valves of said cylinders, provided with known exhaust ducts in faces of valve seats. Said passages are made in the material of the head or are in a form of pipes, the inlet of each of them being an insert with one or several nozzles, situated preferably as close as possible to the wall of the combustion chamber of a given cylinder. Said nozzles limit the amount of exhaust gases serving for creation of turbulence and gasification of the mixture, and at the same time they protect against getting in of the flame to a given connecting conduit.

The method of creating turbulence and gasification of the air-fuel mixture according to the invention has an advantage consisting in that it provides for creating turbulence and gasification of the mixture with the same intensity during the whole suction cycle, said process being performed at a use of exhaust gases of a high temperature facilitating gasification of the mixture, and of a high energy. Due to this the fuel consumption is reduced and the toxicity of exhaust gases is decreased.

Advantages of the system according to the invention are: simple design and reliability of operation resulting therefrom.

Figure 4:
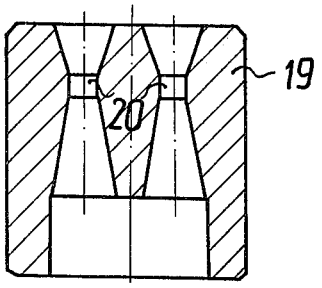
Figure 3:
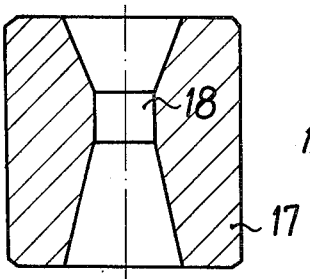
Figure 2:
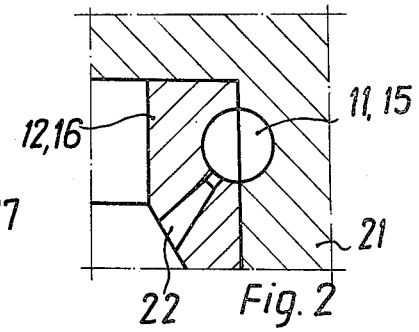

In order to explain in more detail the essence of the invention, the system according to the invention is presented schematically in an example of an embodiment of a two-cylinder engine in a drawing, in which FIG. 1 shows the cross-section of the engine in the plane of suction valves and axes of the cylinders, FIG. 2 shows an enlargement of a detail of the suction valve seat in the longitudinal section, FIG. 3—an insert with a throttle nozzle, and FIG. 4—the insert in another version of an embodiment, having more than one throttle nozzle.

In the situation as shown in FIG. 1 of the drawing, in a cylinder 1 a suction stroke is performed, and in a cylinder 2—a working stroke. In the cylinder 1 a suction valve 3 is open, whereas an exhaust valve 4 is closed, and in the cylinder 2 both valves: a suction valve 5 and an exhaust valve 6 are closed. Both pistons 7 and 8, working synchronously, move downwards.

A combustion chamber 9 of the cylinder 1 is connected by means of a conduit 10 made in a head 21 with an annular passage 11 surrounding a seat 12 of the suction valve 5 of the cylinder 2, whereas a combustion chamber 13 of the cylinder 2 is connected by means of a conduit 14 made also in the head 21 with an annular passage 15 surrounding a seat 16 of the suction valve 3 of the cylinder 1.

Conduits 10 and 14 guiding the exhaust gases are provided at their inlets with an insert 17 with a throttle nozzle 18 or with an insert 19 with several throttle nozzles 20, situated in the vicinity of the walls of the combustion chambers 9 and 13.

As shown in FIG. 2 of the drawing, the annular passages 11 and 15 surrounding the seats 12 and 16 of the suction valves 3 and 5 are connected with several exhaust ducts 22 which widen in the direction of their outlets situated in faces of the seats 12 and 16 of the suction valves 3 and 5. Longitudinal axes of the exhaust ducts 22 are askew or warped in relation to longitudinal axes of the suction valves 3 and 5 so that exhaust gases outflowing therefrom cause, apart from microturbulence, also macroturbulence and gasification of the mixture sucked in by the engine.

In the situation as shown in FIG. 1 of the drawing, exhaust gases from the combustion chamber 13 of the cylinder 2 flow through the conduit 14 to the annular passage 15 surrounding the seat 16 of the suction valve 3 of the cylinder 1, and further on through the exhaust ducts 22 in said seat they flow to the cylinder 1, causing micro- and macro-turbulence and gasification of the mixture inflowing thereto.

After a revolution of the engine shaft by 360° the situation will change: the suction valve 3 and the exhaust valve 4 of the cylinder 1 will be closed and in the cylinder 1 a working stroke will be performed. On the other hand, in the cylinder 2 a suction stroke will be effected: the suction valve 5 will be open, and the exhaust valve 6 of said cylinder will be closed. Then exhaust gases will flow from the combustion chamber 9 of the cylinder 1 through the conduit 10 to the annular passage 11 surrounding the seat 12 of the suction valve 5 of the cylinder 2, and then through the exhaust ducts 22 in the seat 12 they will outflow to the cylinder 2, also causing turbulence and gasification of the mixture sucked in thereto.

As it can be seen, the process of collecting exhaust gases from one of the cylinders 1 or 2 (from the one in which a working stroke is performed) lasts for as long as long in the other one of the cylinders 1 or 2 a suction stroke is being performed. During the whole period of opening the suction valves 3 or 5 the exhaust gases outflowing from the exhaust ducts 22, due to the fact that they are collected directly from the combustion chamber 9 or 13 in the working cycle, have a high temperature and energy, providing thus for a very big effectiveness of gasification and turbulence of the air-fuel mixture.

What is claimed is:

1. A system for the creation of turbulence and gasification of the air-fuel mixture in a spark-ignition four-stroke internal combustion engine with an even number of cylinders, in which cylinders co-operating with each other constitute pairs of a synchrous motion of pistons, whereof when in one a working stroke is performed, then in the other one a suction stroke is performed, whereby said cylinders are connected with each other so that the working space of the first cylinder is connected by means of an annular passage surrounding the seat of the suction valve of the other cylinder and vice versa, whereby the annular passages surrounding the seats of suction valves, made in the material of a valve and/or a head, are connected with exhaust ducts widening in the direction of their outlets situated in faces of the seats of the suction valves, characterized in that conduits (10, 14) connecting combustion chambers (9, 13) with annular passages (11, 15) surrounding seats (12, 16) of suction valves (3, 5), are made in the material of a head (21) or are in a form of pipes, whereby their inlets situated in walls of the combustion chambers (9, 13) are provided with inserts (17) with a throttle nozzle (18), situated preferably as close as possible to walls of the combustion chambers (9, 13).

2. A system according to claim 1, characterized in that the conduits (10,14) connecting the combustion chambers (9, 13) with the annular passages (11, 15) surrounding the seats (12, 16) of the suction valves (3, 5) are provided at their inlets with inserts (19) having more than one throttle nozzles (20) each.

3. A system according to claim 1 or 2, characterized in that the cylinders (1, 2) are connected each with each by means of more than one conduit (10, 14).

4. A method of a creation of a turbulence and gasification of an air-fuel mixture in a spark-iginition four-stroke internal combustion engine with an even number of cylinders by the steps of (1) forming an air fuel mixture,
(2) burning the fuel mixture in the cylinders of the engine,
(3) introducing exhaust gas directly from cylinders undergoing a power stroke into cylinders undergoing a suction stroke,
(4) continuing such introduction throughout the suction process to obtain turbulence and gasification of said air fuel mixture.

* * * * *